US005613800A

United States Patent [19]

Kneeland

[11] Patent Number: 5,613,800

[45] Date of Patent: Mar. 25, 1997

[54] PAVEMENT REPAIR APPARATUS AND METHOD OF REPAIRING ROADS

[76] Inventor: Reginald J. Kneeland, 14104 Bison Ct., Glenelg, Md. 21737

[21] Appl. No.: 431,959

[22] Filed: May 1, 1995

[51] Int. Cl.[6] ..... E01C 19/22

[52] U.S. Cl. ..... 404/75; 404/90; 404/103; 299/39.1

[58] Field of Search ..... 404/17, 35, 72, 404/75, 83, 84.1, 90, 91, 92, 93, 94, 102, 108; 299/39.1, 39.2, 39.3, 39.5

[56] References Cited

U.S. PATENT DOCUMENTS

| | | | |
|---|---|---|---|
| 3,217,620 | 11/1965 | Mindrum et al. | 404/107 |
| 3,625,120 | 12/1971 | Nagy | 404/107 |
| 4,302,127 | 11/1981 | Hodson | 404/102 |
| 4,423,980 | 1/1984 | Warnock | 404/83 |
| 4,511,284 | 4/1985 | Sterner | 404/111 |
| 4,557,626 | 12/1985 | McKay et al. | 404/90 |
| 4,579,479 | 4/1986 | Bryant | 404/128 |
| 4,676,689 | 6/1987 | Yant | 404/110 |
| 4,704,046 | 11/1987 | Yant | 404/109 |
| 4,830,533 | 5/1989 | Miller | 404/101 |
| 5,006,012 | 4/1991 | Sterner | 404/107 |
| 5,131,788 | 7/1992 | Hulicsko | 404/108 |
| 5,236,275 | 8/1993 | Kneeland et al. | 404/75 |
| 5,336,019 | 8/1994 | Hollon et al. | 404/72 |

FOREIGN PATENT DOCUMENTS

| | | |
|---|---|---|
| 2528085 | 12/1983 | France . |
| 2576336 | 7/1986 | France . |

*Primary Examiner*—Denise L. Ferensic
*Assistant Examiner*—Pamela A. O'Connor
*Attorney, Agent, or Firm*—James Creighton Wray

[57] ABSTRACT

Pavement repairs are made by a single person working alone with the new repair apparatus. Blacktop is stored in a sander bin on a truck. An operator periodically replenishes a hopper from the sander bin by aligning the hopper under a discharge assistant of the sander bin and activating the discharge assistant. Standing on a platform at the side of the frame, the operator moves hydraulic controls to move a carriage with hydraulic cylinders from side to side and back and forth on a frame cantilevered from the rear of the truck and anchored to the truck body beneath the sloping sides of the sander bin. The operator aligns an auger guide mounted on the carriage with a hole and lowers a digging auger into the hole. Loose material is removed by air blasts and vacuum. The operator then raises the digging auger and moves the carriage to align the lower end of a sloping discharge chute over the hole. A hydraulic motor is activated to drive a discharge auger in the chute to fill the hole with material from the chute and the bin. Roller support arms are then pivoted downward to swing a roller outside the chute downward into contact with the repair. The operator moves the carriage and the roller back and forth over the repair. The support arms and the roller are raised before the carriage moves the digging auger to the new holes.

19 Claims, 4 Drawing Sheets

FIG. 1
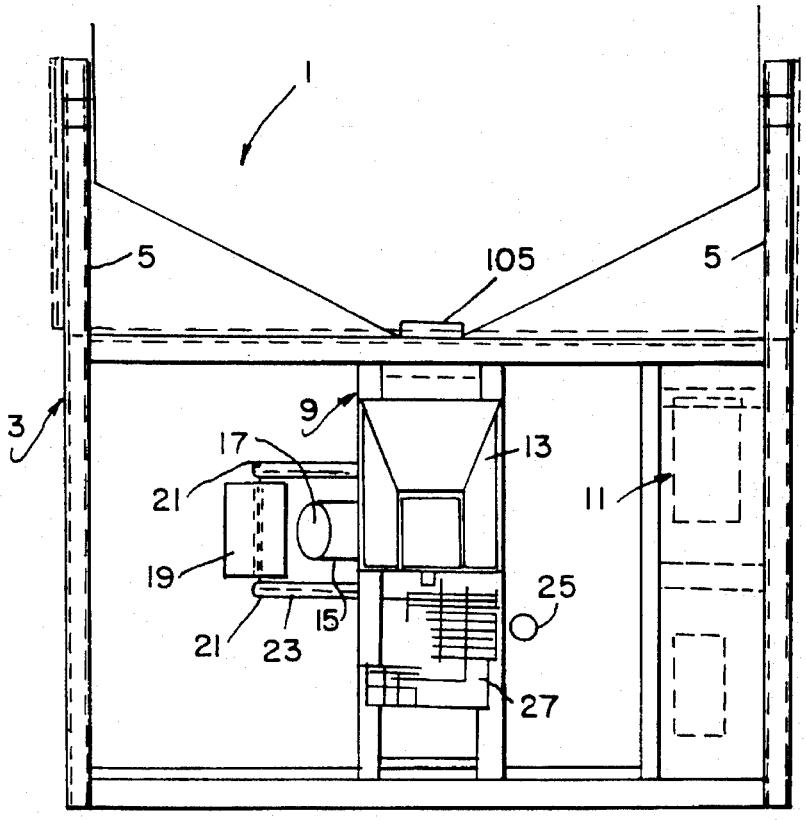
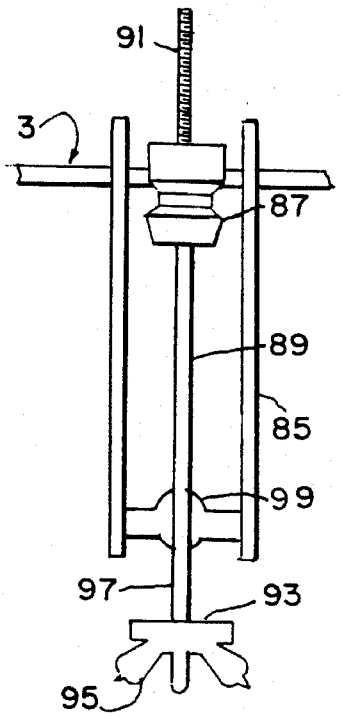
FIG. 6
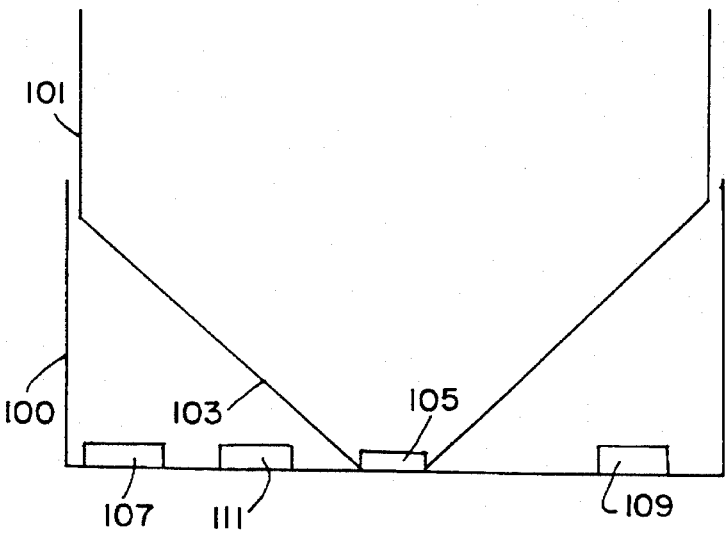
FIG. 7

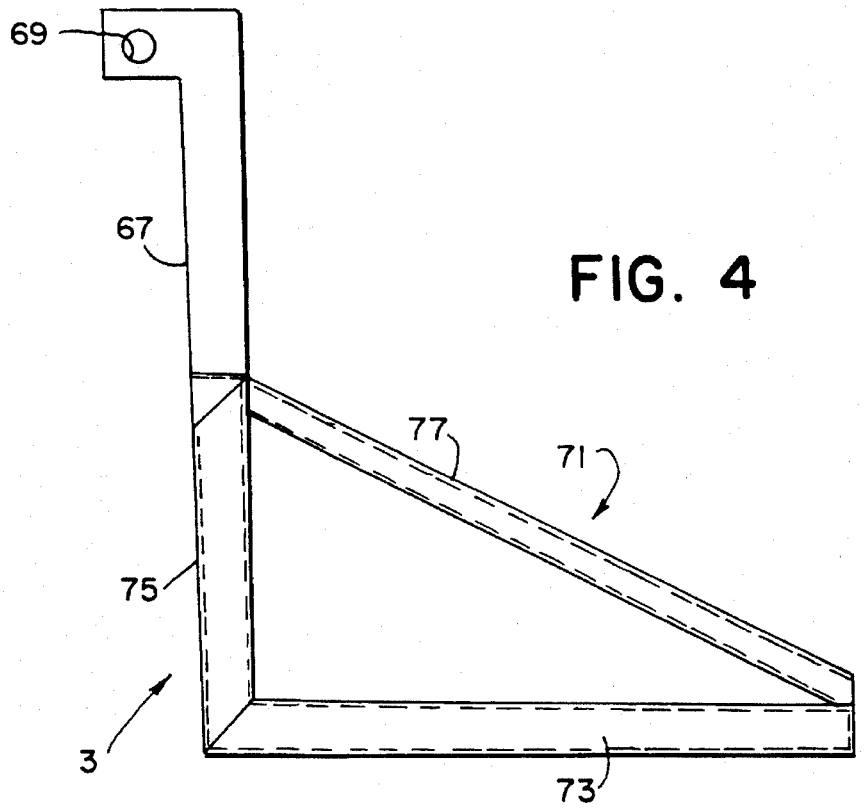
FIG. 4
FIG. 5
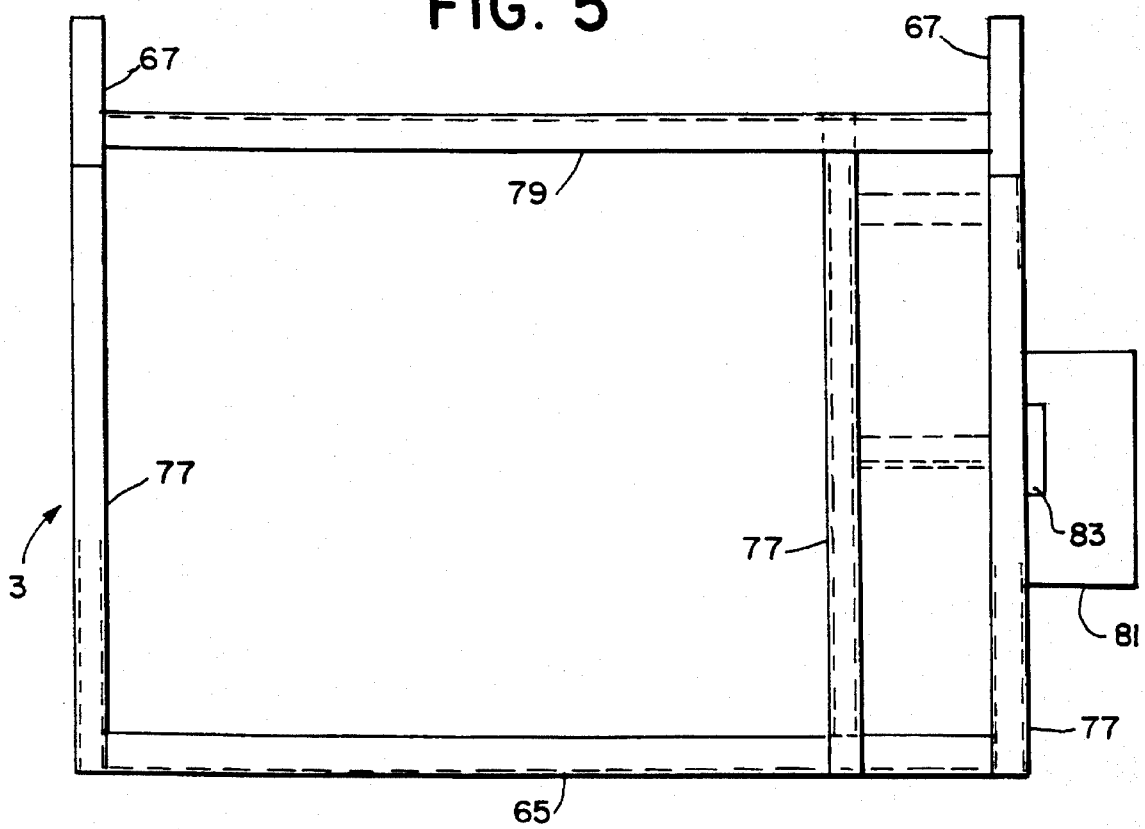

PAVEMENT REPAIR APPARATUS AND METHOD OF REPAIRING ROADS

BACKGROUND OF THE INVENTION

This invention relates to pavement repairs. Pavement repairs are costly and create large portions of road maintenance budgets. The blacktop material used to make the repairs is relatively inexpensive. Labor costs are the major expense of road repairs. The labor costs are directly related to the number of people that make the repairs and the time required for preparation of the holes to be repaired, the filling and the compressing of the material, and then moving to new holes.

Needs have long existed for road repairing apparatus and methods which reduce costs.

SUMMARY OF THE INVENTION

In the present invention, pavement repairs are made by a single person working alone with the new repair apparatus. Blacktop is stored in a sander bin on a truck. An operator periodically replenishes a hopper from the sander bin by aligning the hopper under a discharge assistant of the sander bin and activating the discharge assistant. Standing on a platform at the side of the frame, the operator moves hydraulic controls to move a carriage with hydraulic cylinders from side to side and back and forth on a frame cantilevered from the rear of the truck and anchored to the truck body beneath the sloping sides of the sander bin. The operator aligns an auger guide mounted on the carriage with a hole and lowers a digging auger into the hole. Loose material is removed by air blasts and vacuum. The operator then raises the digging auger and moves the carriage to align the lower end of a sloping discharge chute over the hole. A hydraulic motor is activated to drive a discharge auger in the chute to fill the hole with material from the chute and the bin. Roller support arms are then pivoted downward to swing a roller outside the discharge end of the chute downward directly into contact with the repair material in the hole. The operator moves the carriage and the roller back and forth over the repair material, compressing and sealing the repair. The support arms and the roller are raised before the carriage moves the digging auger to a new hole.

A preferred pavement repair apparatus has a frame for mounting on the back of a truck. An operator's platform mounted on the frame, preferably at the side. A carriage is mounted on the frame for moving on the frame with respect to the truck. A chute is connected at an angle to the frame and a discharge auger is mounted in the chute. A motor connected to the discharge auger at an upper end of the chute moves repair materials through the chute. A hopper mounted on the carriage feeds the chute. An axle is connected beneath a lower portion of the chute. Support arms have proximal ends connected to the axle on opposite sides of the chute. A roller is connected between distal ends of the arms. Hydraulic cylinders are connected to the arms and to the carriage for raising the arms in an arc around the distal end of the chute so that the roller is stored above the chute. The cylinders lower the arms so that the roller is below the chute near the discharge end, in contact with a repaired pavement. Hydraulic motors connected between the frame and the carriage move the carriage along the frame.

In a preferred embodiment, a digging auger assembly is mounted on the frame for digging loose material from pavement holes. The auger assembly has a generally vertical auger guide, an auger shaft movable generally vertically and rotatable within the auger guide, an auger digger head on a lower end of the auger shaft. An auger drive motor is connected to an upper portion of the auger shaft remote from the auger digger head. Lifting and lowering apparatus, which may be any actuator such as a screw thread and nut, or a lever or a ram, is connected to the auger shaft for raising and lowering the auger shaft in the auger guide. Preferably the auger guide is connected to the carriage for movement with the carriage.

The invention includes a sander bin having sloped lower walls and a discharge assistant at the bottom of the sloped lower walls as a blacktop carrier. The bin is mounted on the truck for filling the hopper when the hopper is positioned adjacent the discharge assistant.

An operator's platform may be mounted on a side of the frame for positioning the operator's platform behind a side of the truck. Hydraulic controls on the operator's platform control carriage drive cylinders, the digger auger actuator and drive motor, the air blaster and vacuum, the discharge auger motor and the roller arm cylinders. The operator controls direction and application of hydraulic power to move the carriage, operate the digger auger, remove the debris, operate the discharge auger, lower the roller, cycle the carriage back and forth to roll the repair, and lift the roller.

The preferred method of repairing roads includes storing blacktop in a sander box mounted in a truck, feeding blacktop materials from the sander box with a feed belt to a hopper, storing a supply of blacktop in the hopper. The new method includes positioning a digging auger over a pavement hole, lowering the digger auger into the pavement hole, operating the digger auger and digging loose material from the pavement hole, removing loose material from the pavement hole and lifting the auger. The new method of the invention embodies directing a sloping chute to the clean hole, operating a discharge auger in the sloping chute and discharging blacktop from the hopper and sloping chute into the pavement hole with the discharge auger in the sloping chute. The new method adds hydraulically pivoting roller support arms and lowering a roller between the arms in an arc around the chute discharge end into contact with the blacktop material in the hole. Moving the roller across the blacktop material in the hole, raising the roller and support arms and moving the apparatus to a new hole to be cleaned completes one operation.

Preferably the removing of loose material involves dislodging loose material with air pressure and vacuuming loose material with reduced pressure. The positioning includes moving a carriage, a carrier, and moving the carrier on a frame with hydraulic motors. The frame is mounted on a truck and extends from a rear of the truck.

Preferably controlling the positioning and operating are accomplished from an operator's platform mounted on the frame to the rear of and to a side of the truck.

These and further and other objects and features of the invention are apparent written specification, with the claims and the drawings.

BRIEF DESCRIPTION OF THE DRAWINGS

FIG. 1 is a plan view of the invention.

FIG. 4 is a side elevation of the frame.

FIG. 5 is a plan view of the frame.

FIG. 6 is a detail of the digger auger.

FIG. 7 is a detail of the sander box which stores a large supply of the blacktop.

DETAILED DESCRIPTION OF THE PREFERRED EMBODIMENTS

Figure 2:
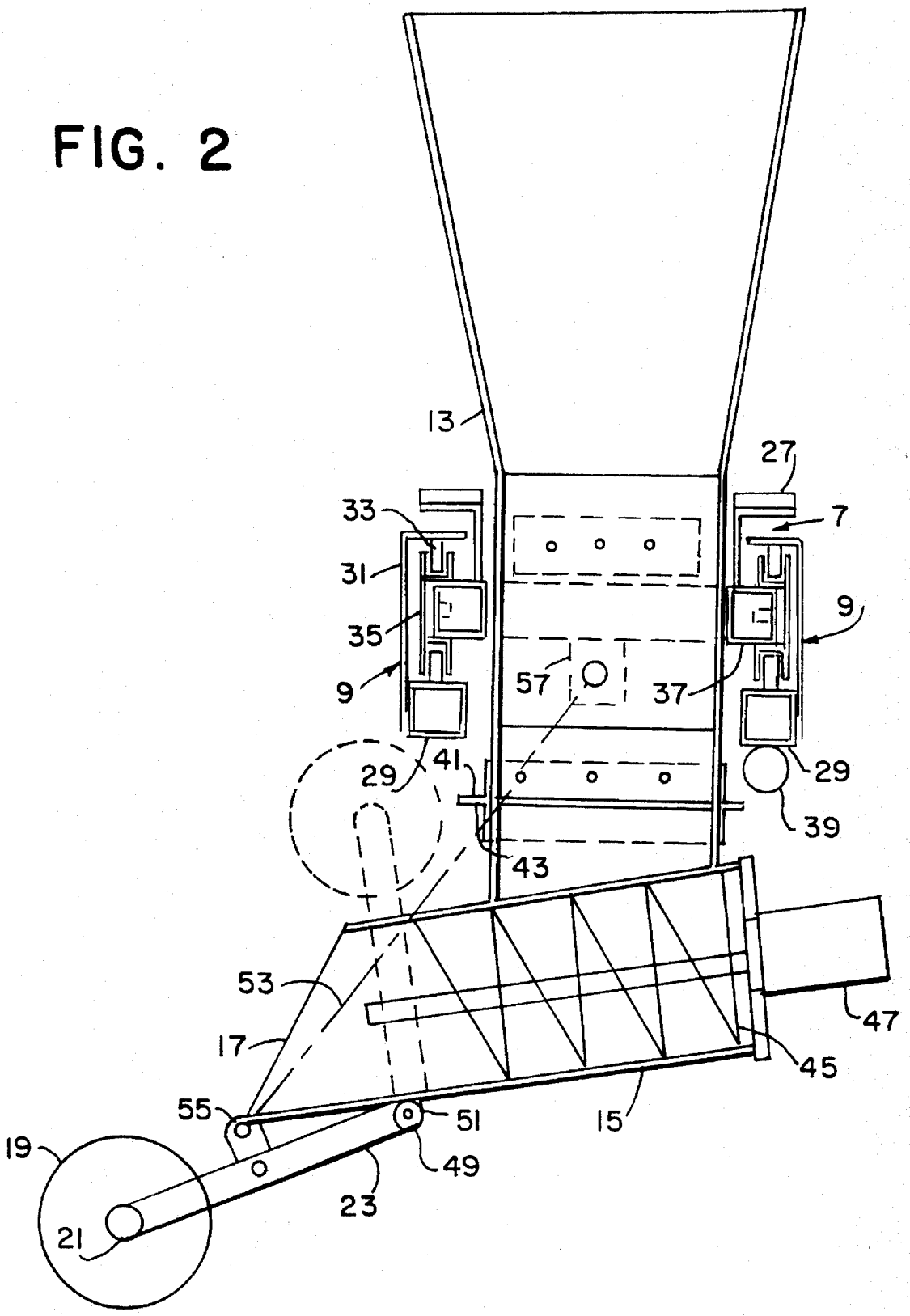
FIG. 2 is an end elevational detail partially in cross-section.

Referring to the drawings, a repair apparatus is generally indicated by the numeral 1. The apparatus has a frame 3 with forward extending arms 5 for mounting on a truck. A forward and Also the unit may be hooked directly to truck in the same manner as the tail gate is attached rearward movable carriage 7 is mounted on a carrier 9, which moves laterally with respect to the truck and the frame. Hydraulic drive units with pumps and sources of hydraulic pressure are generally indicated by the numeral 11 and are shown mounted at one side of the frame. Alternatively, the hydraulic system can come directly from the truck itself elevating auxillary unit. Because the carrier 9 moves laterally and carriage 7 moves forward and rearward on the carrier, the carriage can move to all positions on the frame 3.

The carriage 7 carries a hopper 13, the lower end of which communicates with the upper end of a sloping chute 15 with a discharge end 17. A roller 19 is rotationally supported between distal ends 21 of arms 23 so that the roller can move in an arc outside of the discharge end 17 of the chute. A digger auger assembly 25 is mounted on one side of the carriage. An operator's platform 27 may be carried on the carriage and may be cantilevered outward beyond the rear of the frame as the carriage is moved rearward.

As shown in the side elevational cross-sectional detail of FIG. 2, the carrier 9 which moves laterally along the frame 3 of FIG. 1 has parallel box beams 29 and vertical members 31, which carry rollers 33. Guides or rollers 35 are mounted on the rails and support the box beams 37 which form the basic structure of the carriage 7. Hydraulic motors 39 are connected to the box beams 29 of carrier 9 and have opposite ends connected to the carriage 7 for moving the carriage forward and rearward on the carrier 9. Grating which forms the operator's platform 27 is also shown at the side of hopper 13 as an alternative both positions are available. A flange 41 at the lower end of the hopper connects to a flange 43 at the upper end of the angled discharge chute 15. A discharge auger 45 in the angled discharge chute 15 is driven by a discharge motor 47 to drive the blacktop repair material from discharge end 17 of the slope chute 15. An axle 49 connected to the bottom of the discharge chute 15 near its discharge end 17 has at opposite ends thereof proximal ends 51 of the roller support arms 23. Distal ends 21 of the arms support the roller 19. Hydraulic cylinders schematically shown by line 53 connect lugs 55 on support arms 23 with lugs 57 on the carriage 7 to raise and lower the support arms and the roller.

Figure 3:
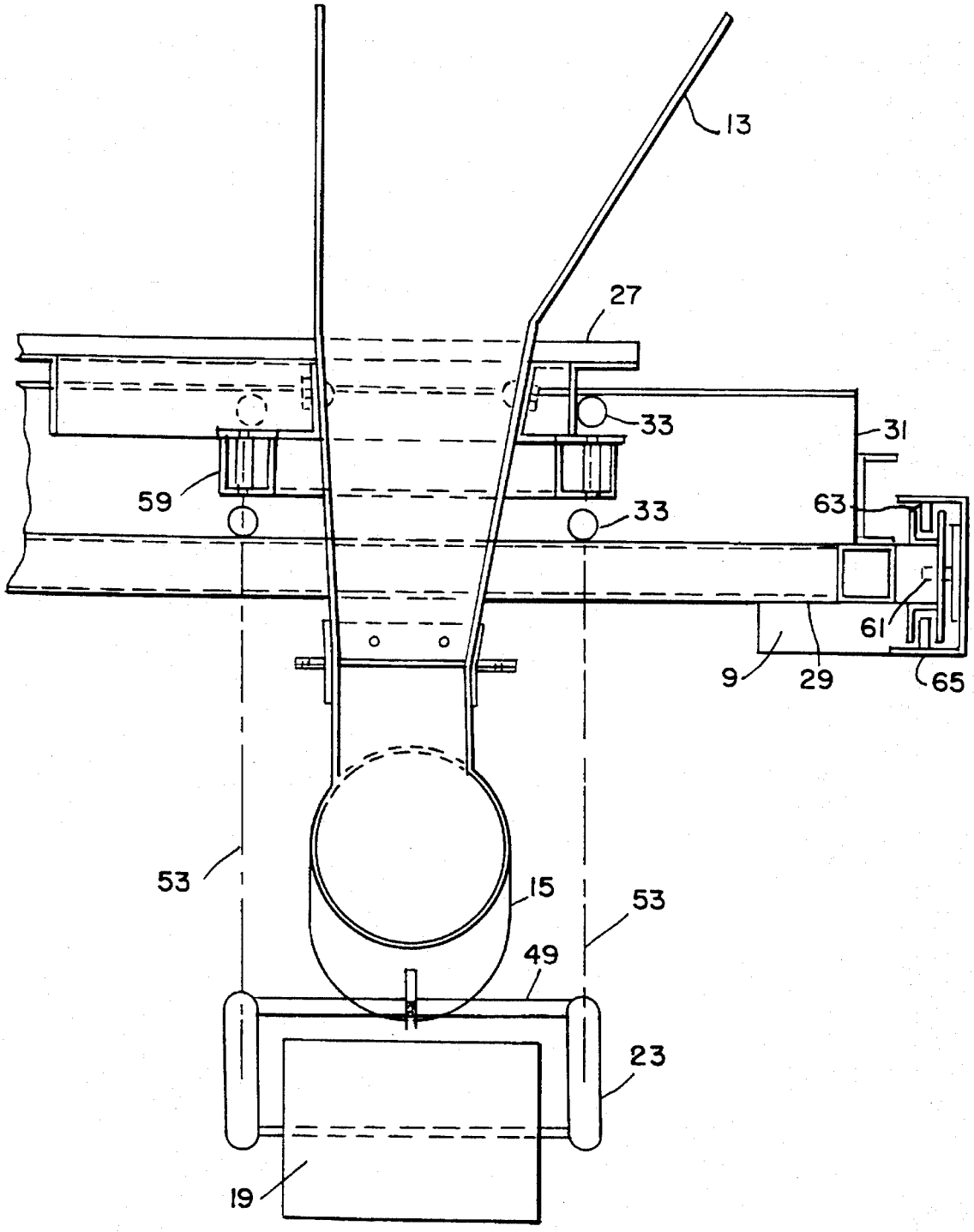
FIG. 3 is a side elevational detailed partially in cross-section.

FIG. 3 is a partial cross-sectional side elevation of the carriage 7 showing the horizontally mounted rollers 33 and vertically mounted rollers 59, which guide the carriage back and forth on the carrier 9. The carrier 9 has rollers 61 mounted on vertical axles, and vertically mounted rollers 63 on horizontal axles, which support ends of the carrier box beams 29 in the frame members 65. In FIG. 3 the roller 19 is shown in its lowered position, and actuating cylinders 53 are shown schematically as lines to provide clarity.

FIG. 4 is a side elevation of the frame 3 showing the anchoring members 5 which extend into the truck. Vertical members 67 on the anchoring member are bolted to walls of a truck box. The frame has a truss-like structure 71, which includes rearward cantilevered members 73, vertical side members 75, and diagonal members 77. Also is anchored to truck in the same manner as a tailgate is attached.

As shown in FIG. 5, rearward opening channel member 79 mounted in the back of the truck and a forward opening channel member 65 form the rails on which the carrier 9 moves from side to side on the frame 3 at the back of the truck.

In a preferred embodiment, an operator's platform 81 can be mounted at the side of the frame 3 so that an operator is positioned to a side of the truck. A control panel 83 above the operator's platform 81 provides full control of the hydraulics.

FIG. 6 is a schematic representation of the digging auger assembly. Guide tube 85 is connected to the carriage 3, and a hydraulic motor 87 is mounted inside the carriage. The motor is connected to an auger shaft 89, for raising and lowering the auger shaft along the guide 85. The auger shaft 89 has screw threads 91 at its upper end so that a turnable, vertically fixed nut may raise and lower the auger, either hydraulically or by hand. Alternatively, the auger may be raised and lowered with a ram. An auger head 93 with cutting teeth 95 is mounted at the lower end 97 of the auger shaft 89. The digging auger is positioned over pavement holes for digging loose material from the pavement holes.

FIG. 7 schematically shows the truck body 100 in which a sander box 101 has been mounted. The sander box has sloped lower walls 103 and a discharge assistant 105, which is a feed belt which feeds blacktop from within the sander box into the top of the hopper 13.

Also mounted on the truck is an air compressor 107 and storage tank 109 to provide air blasts near the bottom of the auger guide 85 to drive loose material from holes. The truck also carries a vacuum 111 with an opening near the bottom end of the auger guide 85 to remove loose debris from the hole and the surrounding area. Alternatively, the loose material blown from the hole with air blasts is driven beyond the side of the road with blasts to augment the shoulder-forming material. The air can be obtained from the auxillary air supply of the truck itself.

While the invention has been described with reference to specific embodiments, modifications and variations of the invention may be constructed without departing from the scope of the invention, which is defined in the following claims.

I claim:

1. Pavement repair apparatus comprising a frame for mounting on the back of a truck, a platform mounted on the frame, a carriage mounted for moving on the frame with respect to the truck, an angled chute connected at an angle to the frame and a discharge auger mounted in the angled chute, a motor connected to the discharge auger at an upper end of the angled chute for moving repair materials through the chute, a hopper mounted on the carriage and communicating with the chute, an axle connected beneath a lower portion of the chute, support arms having proximal ends connected to the axle on opposite sides of the chute and having distal ends, a roller connected between distal ends of the support arms, hydraulic cylinders connected to the support arms and to the carriage for raising the arms so that the roller is above the chute, and for lowering the arms so that the roller is below the chute and in contact with a repaired pavement.

2. The apparatus of claim 1, further comprising a carrier movable on the frame and supporting the carrier, hydraulic cylinders connected between the frame, the carrier and the carriage for moving the carrier along the frame and the carriage along the carrier.

3. The apparatus of claim 1, further comprising a digging auger mounted on the frame for digging loose material from pavement holes.

4. The apparatus of claim 3, wherein the digging auger further comprises a generally vertical auger guide, an auger shaft movable generally vertically and rotatable within the auger guide, an auger digger head on a lower end of the auger shaft, and an auger drive motor connected to an upper portion of the auger shaft remote from the auger digger head.

5. The apparatus of claim 4, further comprising lifting and lowering apparatus connected to the auger shaft for raising and lowering the auger shaft in the auger guide.

6. The apparatus of claim 5, wherein the auger guide is connected to the carriage for movement with the carriage.

7. The apparatus of claim 1, further comprising a sander bin having sloped lower walls and a discharge assistant at the bottom of the sloped lower walls mounted on the truck for filling the hopper when the hopper is positioned adjacent the discharge assistant.

8. The apparatus of claim 1, further comprising an alternative operator's platform mounted on a side of the frame for positioning the operator's platform behind and to a side of the truck, and hydraulic controls connected to the operator's platform and to the carriage drive cylinders to the discharge auger motor, to the digger auger motor, and to the roller arm cylinders for controlling direction and application of hydraulic power to move the carriage, operate the digger auger, operate the discharge auger, lower the roller, cycle the carriage back and forth to roll the repair, and lift the roller.

9. The method of repairing roads, comprising storing blacktop in a sander box mounted in a truck, feeding blacktop materials from the sander box with a feed belt to a hopper, storing a supply of blacktop in the hopper, positioning a digging auger over a pavement hole, lowering the digger auger into the pavement hole, operating the digger auger and digging loose material from the pavement hole, removing loose material from the pavement hole, lifting the auger, directing a sloping chute to the hole, operating a discharge auger in the sloping chute and discharging blacktop from the hopper and sloping chute into the pavement hole with the discharge auger in the sloping chute, hydraulically pivoting roller support arms and lowering a roller between the arms into contact with the blacktop material in the hole, moving the roller across the blacktop material in the hole, raising the roller and support arms and moving the apparatus to a new hole to be cleaned.

10. The method of claim 9, wherein the removing of loose material comprises dislodging loose material with air pressure and vacuuming loose material with reduced pressure.

11. The method of claim 9, wherein the positioning comprises supporting a movable carriage on a movable carrier and supporting the movable carrier on a frame mounted on a truck and extending from a rear of the truck, and moving the carrier and the carriage with hydraulic motors.

12. The method of claim 9, further comprising controlling the positioning and operating from an operator's platform mounted on a frame to the rear of and to a side of a truck.

13. The method of claim 9, wherein the pivoting, lowering and raising comprise pivoting, lowering and raising distal ends of the arms and the roller in an arc beyond a lower discharge end of the sloping chute.

14. The method of repairing roads by an apparatus, comprising storing a supply of blacktop in a hopper, positioning a digging auger over a pavement hole, lowering the digger auger into the pavement hole, operating the digger auger and digging loose material from the pavement hole, removing loose material from the pavement hole, lifting the auger, directing a sloping chute to the hole, operating a discharge auger in the sloping chute and discharging blacktop from the hopper and sloping chute into the pavement hole with the discharge auger in the sloping chute, hydraulically pivoting roller support arms and lowering a roller between the arms into contact with the blacktop material in the hole, moving the roller across the blacktop material in the hole, raising the roller and support arms and moving the apparatus to a new hole to be cleaned.

15. The method of claim 14, wherein the removing of loose material comprises dislodging loose material with air pressure and vacuuming loose material with reduced pressure.

16. The method of claim 14, wherein the positioning comprises supporting a movable carriage on a movable carrier and supporting the movable carrier on a frame mounted on a truck and extending from a rear of the truck, and moving the carrier and the carriage with hydraulic cylinders.

17. The method of claim 14, further comprising controlling the positioning and operating from an operator's platform mounted on a frame to the rear of and to a side of a truck.

18. The method of claim 14, wherein the pivoting, lowering and raising comprise pivoting, lowering and raising distal ends of the arms and the roller in an arc beyond a lower discharge end of the sloping chute.

19. The method of claim 14, further comprising the hopper storing blacktop in a sander box mounted in a truck, and feeding blacktop materials from the sander box with a feed belt to the hopper.

* * * * *